US011952716B2

(12) United States Patent
Rossetti

(10) Patent No.: US 11,952,716 B2
(45) Date of Patent: Apr. 9, 2024

(54) TRIPLE PAPERMAKING FABRIC

(71) Applicant: FELTRI MARONE S.P.A., Milan (IT)

(72) Inventor: Clara Rossetti, Milan (IT)

(73) Assignee: FELTRI MARONE S.P.A., Milan (IT)

( * ) Notice: Subject to any disclaimer, the term of this patent is extended or adjusted under 35 U.S.C. 154(b) by 36 days.

(21) Appl. No.: 17/792,979

(22) PCT Filed: Jan. 15, 2021

(86) PCT No.: PCT/IB2021/050300
§ 371 (c)(1),
(2) Date: Jul. 14, 2022

(87) PCT Pub. No.: WO2021/144756
PCT Pub. Date: Jul. 22, 2021

(65) Prior Publication Data

US 2023/0048963 A1 Feb. 16, 2023

(30) Foreign Application Priority Data

Jan. 15, 2020 (IT) ..... 102020000000637

(51) Int. Cl.
*D21F 7/08* (2006.01)
*D21F 1/00* (2006.01)
*D03D 13/00* (2006.01)

(52) U.S. Cl.
CPC ..... *D21F 1/0045* (2013.01)

(58) Field of Classification Search
CPC ..... D21F 7/08; D21F 1/0045; D21F 1/0036; D21F 7/083; D03D 11/00; D03D 1/00;
(Continued)

(56) References Cited

U.S. PATENT DOCUMENTS 5,713,396 A * 2/1998 Lee ..... D21F 1/0054 139/408
5,881,764 A * 3/1999 Ward ..... D21F 1/0045 162/903

(Continued)

FOREIGN PATENT DOCUMENTS

EP 1605095 12/2005
EP 2356279 8/2011

OTHER PUBLICATIONS

International Search Report and Written Opinion dated Mar. 26, 2021, in connection with International Application No. PCT/IB2021/050300 (17 pages).

(Continued)

*Primary Examiner* — Robert H Muromoto, Jr.
(74) *Attorney, Agent, or Firm* — KLINTWORTH & ROZENBLAT IP LLP

(57) ABSTRACT

A triple papermaking fabric includes: a set of top MD yarns; a set of top CMD yarns interwoven with the top MD yarns; a set of bottom MD yarns; a set of bottom CMD yarns interwoven with the bottom MD yarns; a set of binding yarns arranged in pairs between respective top CMD yarns; the binding yarns of each pair are interwoven with respective different top MD yarns, and the binding yarns, together, of the pair are interwoven with all the top MD yarns; the binding yarns are arranged in pairs between respective consecutive top CMD yarns; the binding yarns of each pair bind respective different bottom MD yarns, each binding yarn of the pair binding only one bottom MD yarn.

16 Claims, 5 Drawing Sheets

(58) Field of Classification Search
CPC ..... D03D 13/004; D03D 3/04; D03D 13/00; D03D 25/00
See application file for complete search history.

(56) References Cited

U.S. PATENT DOCUMENTS

| | | | | |
|---|---|---|---|---|
| 6,244,306 | B1 * | 6/2001 | Troughton | D21F 1/0045 139/383 B |
| 6,253,796 | B1 * | 7/2001 | Wilson | D21F 1/0045 139/383 A |
| 6,837,277 | B2 * | 1/2005 | Troughton | D21F 1/0045 442/205 |
| 6,904,942 | B2 * | 6/2005 | Odenthal | D21F 1/0045 442/205 |
| 7,243,687 | B2 * | 7/2007 | Barratte | D21F 1/0045 162/348 |
| 7,275,566 | B2 * | 10/2007 | Ward | D21F 1/0036 139/383 A |
| 7,484,538 | B2 * | 2/2009 | Barratte | D21F 1/0045 162/902 |
| 7,571,746 | B2 * | 8/2009 | Hay | D21F 1/0045 139/383 R |
| 7,581,567 | B2 * | 9/2009 | Ward | D21F 1/0045 162/903 |
| 8,539,987 | B2 * | 9/2013 | Rossetti | D21F 1/0045 162/348 |
| 8,631,832 | B2 * | 1/2014 | Heger | D03D 25/00 139/411 |
| 8,758,570 | B2 * | 6/2014 | Rossetti | D21F 1/0045 162/903 |
| 9,856,602 | B2 * | 1/2018 | Rossetti | D21F 1/0027 |
| 11,214,923 | B2 * | 1/2022 | Ward | B32B 5/26 |
| 11,220,784 | B2 * | 1/2022 | Ward | D03D 3/04 |
| 2004/0102118 | A1 * | 5/2004 | Hay | D21F 1/0036 442/181 |
| 2004/0149343 | A1 * | 8/2004 | Troughton | D21F 1/0045 139/383 R |
| 2006/0016509 | A1 * | 1/2006 | Westerkamp | D21F 1/0045 139/383 R |
| 2007/0251594 | A1 * | 11/2007 | Ward | D21F 1/0045 162/212 |
| 2008/0035231 | A1 * | 2/2008 | Hay | D21F 1/0045 139/420 B |
| 2009/0035537 | A1 | 2/2009 | Hack-Ueberall et al. | |
| 2009/0183795 | A1 | 7/2009 | Ward et al. | |
| 2011/0226435 | A1 * | 9/2011 | Rossetti | D21F 1/0045 162/348 |
| 2011/0253334 | A1 * | 10/2011 | Rossetti | D21F 1/0045 162/348 |
| 2015/0322628 | A1 * | 11/2015 | Rossetti | D21F 1/0027 442/239 |
| 2019/0249365 | A1 * | 8/2019 | Ward | D03D 11/00 |
| 2021/0032814 | A1 * | 2/2021 | Ward | B32B 5/024 |
| 2021/0032815 | A1 * | 2/2021 | Ward | D21F 7/083 |

OTHER PUBLICATIONS

International Preliminary Report on Patentability dated Aug. 12, 2021, in connection with International Application No. PCT/IB2021/050300 (16 pages).

* cited by examiner

TRIPLE PAPERMAKING FABRIC

CROSS-REFERENCE TO RELATED APPLICATIONS

This patent application claims priority from Italian patent application no. 102020000000637 filed on 15 Jan. 2020, the entire disclosure of which is incorporated herein by reference.

TECHNICAL FIELD

The present invention relates to a papermaking fabric, intended in particular (but not necessarily) for use as forming fabric in a forming section of a papermaking machine.

BACKGROUND ART

The conventional Fourdrinier papermaking method essentially involves three subsequent steps, carried out in corresponding sections of the papermaking machine: forming section, pressing section, drying section.

In the forming section, an aqueous pulp made of cellulose fibres (and any other components) is arranged on a forming fabric or wire, structured as a closed loop belt and supported by rollers. Removal of water from the pulp through the forming fabric leads to the progressive formation of a web of wet paper material, with a water content that is still relatively high. Further removal of water takes place in the pressing section, where the paper material is pressed, passing between one or more pairs of rollers. The paper material is then sent to the drying section to remove the last moisture. The paper thus formed is ready for the subsequent finishing and packaging steps.

Hereinafter, as is customary in the papermaking and forming fabric field, the terms "machine direction" (abbreviated to "MD") and "cross machine direction" (abbreviated to "CMD") are used to indicate, respectively, a direction aligned with the direction of feed of the forming fabric in the papermaking machine, and a direction parallel to the surface of the fabric and transverse (orthogonal) to the direction of feed. The direction or orientation of the warp and weft yarns of the fabric are also indicated with reference to the machine direction and to the cross machine direction: the warp yarns extend in machine direction and the weft yarns extend in cross machine direction.

Moreover, once again in conformity with common use in the sector, the surface of the forming fabric in contact with the cellulose pulp (i.e., with the paper material to be formed) is intended as the top surface of the fabric; and the opposite surface facing the machine is intended as the bottom surface. This reference is also used to describe the vertical spatial arrangement of the yarns in the forming fabric.

In any part of the machine in which papermaking fabrics are used, it is required to provide correct support for the paper in the various steps of its formation. Moreover, the fabrics must have good stability, even when used on machines that operate at high speeds, and must have good draining capacities to reduce the amount of water retained.

Furthermore, the properties of the paper are greatly influenced by the papermaking fabric, in particular by its surface in contact with the paper.

Although various types of papermaking fabrics are known, in particular for use in the forming section, there still seems to be room for improvements in this field, for example in terms of mechanical strength, stability, duration, draining capacity and quality of the paper formed.

DISCLOSURE OF INVENTION

Therefore, an object of the present invention is to provide a papermaking fabric possessing all these features to a satisfactory degree, and in particular which is fully effective, highly draining, strong and stable over time, and which ensures the manufacture of high-quality paper.

The present invention thus relates to a papermaking fabric as defined in essential terms in the appended claim 1 and, in its additional features, in the dependent claims.

The present invention further relates to the use of this fabric in a papermaking machine, and specifically in the forming section of the machine, and to a papermaking process using this fabric, as defined in the appended claims 14 and 16, respectively.

BRIEF DESCRIPTION OF THE DRAWINGS

The invention is further described in the following non-limiting examples of embodiment, with reference to the accompanying figures, wherein.

BEST MODE FOR CARRYING OUT THE INVENTION

Figure 1:
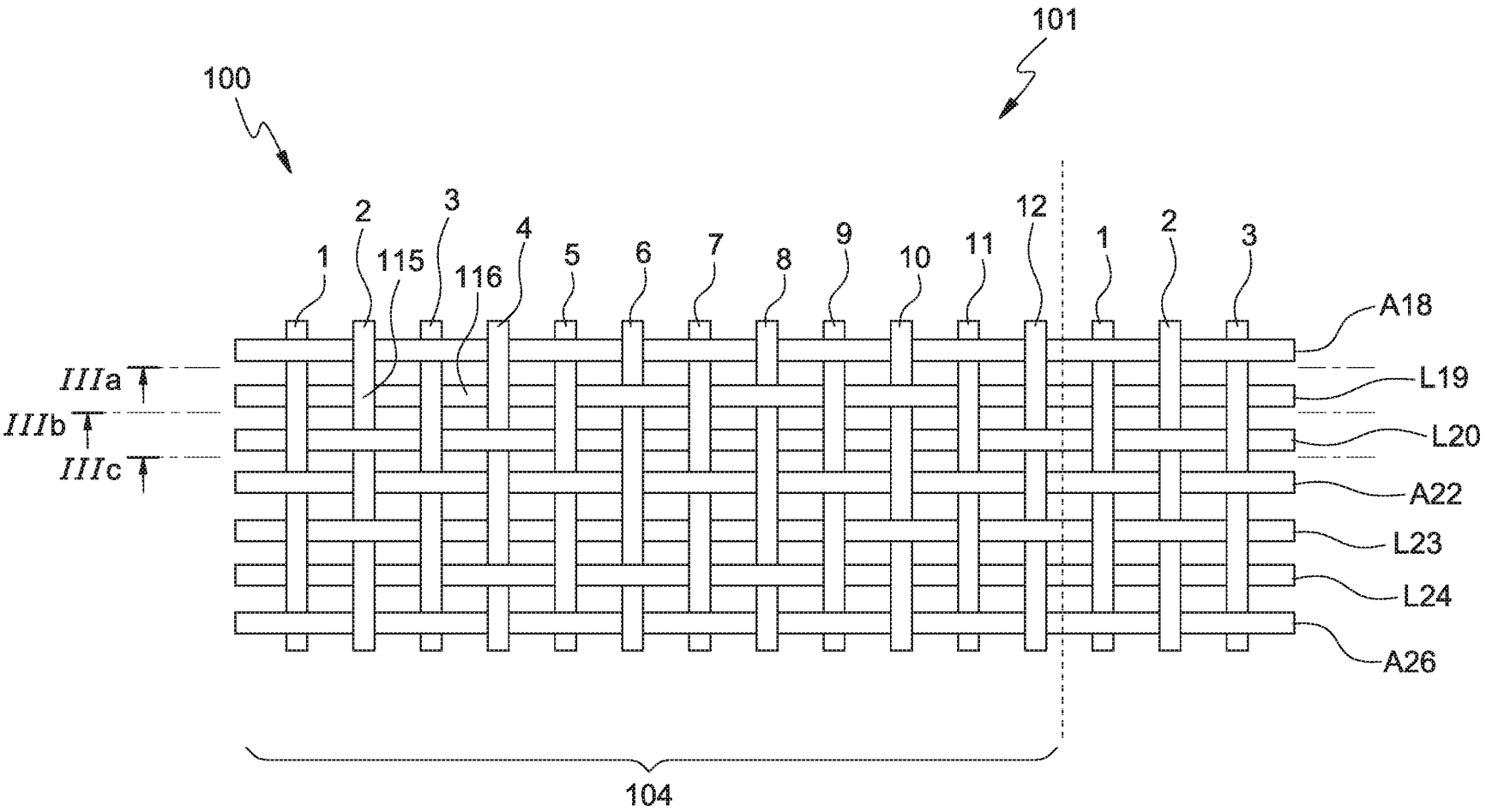
FIG. 1 is a schematic top plan view of a top layer of a fabric according to the invention (of which a fabric repeating unit and the initial part of the subsequent unit are shown)

With reference to the accompanying figures, the reference numeral 100 indicates as a whole a papermaking fabric, in particular a forming fabric to be used in the forming section of a papermaking machine; in the example shown, the fabric 100 is a 20-harness triple fabric.

The fabric 100 comprises a top layer 101 and a bottom layer 102 formed, as is customary, by respective repeating units that, together, form a fabric repeating unit 104; the figures show a single fabric repeating unit 104, and the initial part of the adjacent repeating unit (the corresponding yarns of adjacent repeating units are indicated with the same numbers); it is understood that, in commercial and industrial applications, the unit 104, just as the repeating units of the single layers 101, 102, can be repeated several times, both in machine direction and in cross machine direction, to form a fabric 100 of a suitable size for use on a papermaking machine.

In general, the fabric 100 is formed by longitudinal warp yarns that extend in machine direction (MD) and by transverse weft yarns, substantially orthogonal to the previous yarns, which extend in cross machine direction (CMD). Hereinafter (and as is customary in the field), for the brevity the longitudinal warp yarns that extend in machine direction will be indicated as "MD yarns" and the transverse weft yarns that extend in cross machine direction as "CMD yarns".

In the present case, a repeating unit 104 of the fabric 100 includes twelve top MD yarns 1-12, three top CMD yarns A18,A22,A26, eight bottom MD yarns 13-20, three bottom CMD yarns B17,B21,B25, and four binding yarns L19,L20;

L23,L24 arranged in pairs and comprising respective supporting portions 115 and respective binding portions 116.

The interweaving or weaving of these yarns to form the fabric 100 is described in detail below.

The top layer 101 (FIG. 1) includes the top MD yarns 1-12 and the top CMD yarns A18,A22,A26, and the supporting portions 115 of binding yarns L19,L20;L23,L24.

Figure 2:
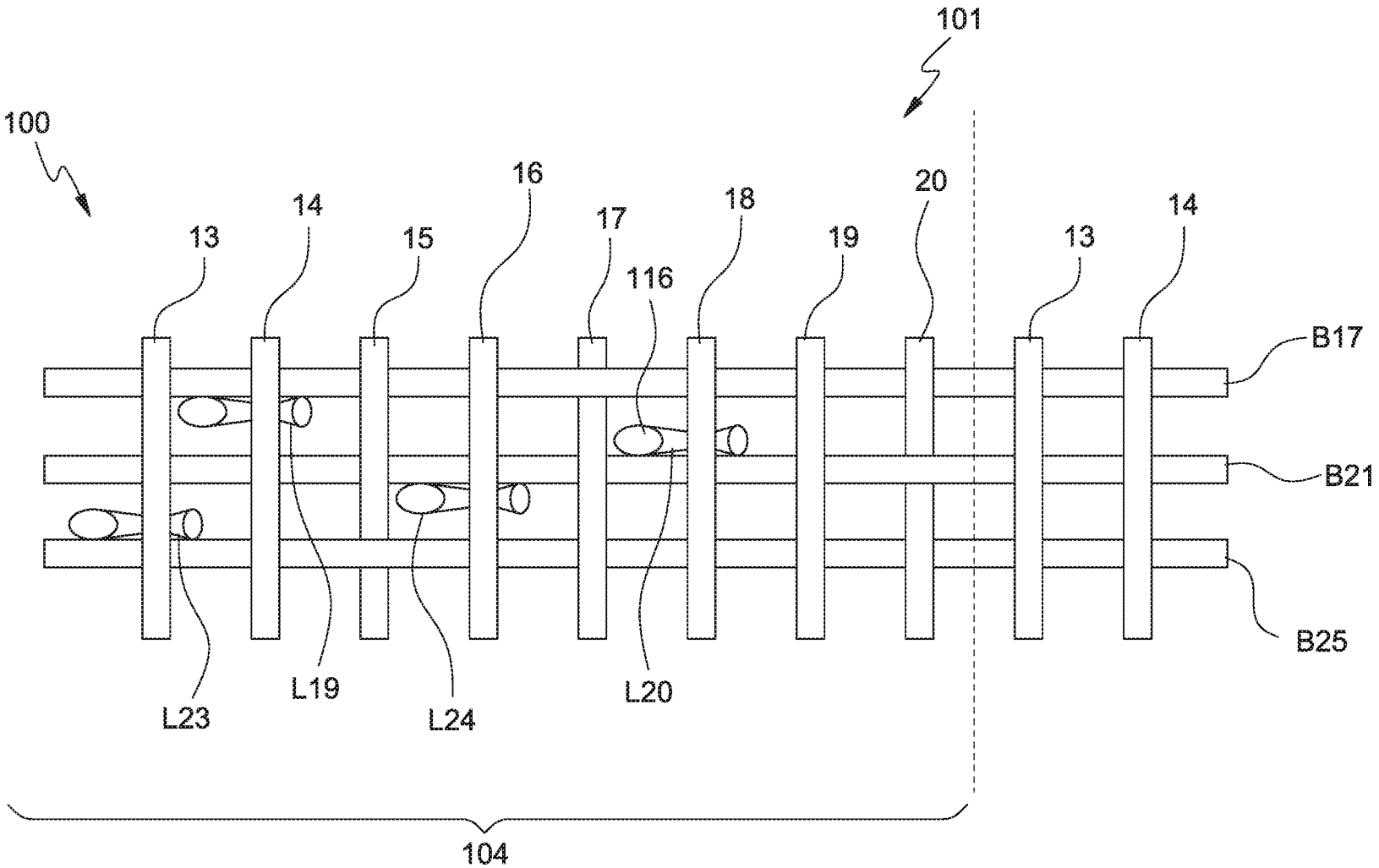
FIG. 2 is a schematic top plan view of a bottom layer of the fabric of FIG. 1 (of which a fabric repeating unit and the initial part of the subsequent unit are shown)

The bottom layer 102 (FIG. 2) comprises the bottom MD yarns 13-20 and the bottom CMD yarns B17,B21,B25, as well as the binding portions 116 of the binding yarns L19,L20;L23,L24 which extend to bind the bottom MD yarns 13-20.

The top MD yarns 1-12 and the top CMD yarns A18, A22,A26 are interwoven so that each top CMD yarn A18, A22,A26 passes alternately over and under the top MD yarns 1-12; all the top CMD yarns A18,A22,A26 are interwoven with the top MD yarns in the same manner, i.e., passing over and under the same top MD yarns; in particular, each top CMD yarn A18,A22,A26 passes over the odd top MD yarns 1,3,5,7,9,11 and under the even top MD yarns 2,4,6,8,10,12. The same pattern is followed by all the top CMD yarns A18,A22,A26.

The layers 101, 102 are joined and bound together to form the fabric 100 by means of the binding yarns L19,L20;L23, L24 arranged in pairs.

As shown in FIG. 1, each pair of binding yarns L19,L20; L23,L24 is arranged between two top CMD yarns A18,A22, A26. For example, the pair of binding yarns L19,L20 is arranged between the top CMD yarns A18,A22 and the pair of binding yarns L23,L24 is arranged between the top CMD yarns A22,A26.

Each binding yarn L19,L20;L23,L24 comprises, in a fabric repeating unit 104, a supporting portion 115, which is interwoven with the top MD yarns 1-12, and a binding portion 116, which is arranged under the top MD yarns 1-12 and is interwoven with the bottom MD yarns 13-20.

In the non-limiting example shown, the supporting portion 115 of each binding yarn L19,L20;L23,L24 is interwoven (i.e., passes alternately over and under) with five consecutive top MD yarns 1-12, and the binding portion 116 passes instead under the remaining top MD yarns 1-12 to bind at least one bottom MD yarn 13-20 (in particular, only one bottom MD yarn 13-20).

The binding yarns L19,L20;L23,L24 of each pair (although represented side by side for clarity, in the out-of-scale schematic view of FIG. 1) are interwoven with each other and vertically superimposed, so that the supporting portions 115 of one binding yarn of the pair are superimposed on the binding portions 116 of the other binding yarn of the pair and vice versa; the two binding yarns L19,L20; L23,L24 of one pair intersect at some of the top MD yarns 1-12 which define respective transition MD yarns (in the present case, the top MD yarns 5,11), under which a binding yarn of each pair crosses the other binding yarn of the pair and which define the transition between the supporting portions 115 and the binding portions 116.

The interweaving of each pair of binding yarns L19,L20; L23,L24 with the top MD yarns 1-12 and the bottom MD yarns 13-20 can take different forms.

In the preferred embodiment shown, for example, with reference to the pair of binding yarns L19,L20, the supporting portion 115 of the odd binding yarn L19 is alternately interwoven, in each fabric repeating unit 104, with five top MD yarns 6-10, passing alternately over the three even top MD yarns 6,8,10 and under the odd top MD yarns 7,9; the supporting portion 115 of the even binding yarn L20 is alternately interwoven with other five top MD yarns 1-4,12, passing alternately over the even top MD yarns 2,4,12 and under the odd top MD yarns 1,3.

Both of the binding yarns L19,L20 of the pair pass under the top transition MD yarns 5,11.

The binding yarns L19,L20;L23,L24 of each pair pass, with the respective supporting portions 115, over those top MD yarns under which the top CMD yarns A18,A22,A26 pass instead; in other words, the supporting portions 115 of the binding yarns L19,L20;L23,L24 pass over the even top MD yarns 2,4,6,8,10,12 (for each pair of binding yarns L19,L20;L23,L24, one or other of the binding yarns passes over each even top MD yarn). The supporting portions 115 of the binding yarns L19,L20;L23,L24 pass instead under those top MD yarns over which the top CMD yarns A18, A22,A26 pass, i.e., under the odd top MD yarns 1,3,5,7,9,11. For example, the binding yarn L19 passes, with its supporting portion 115, over the top MD yarns 6,8,10 while it passes under the top MD yarns 7,9; and the binding yarn L20 passes, with its supporting portion 115, over the top MD yarns 2,4,12 and under the top MD yarns 1,3,11. Both of the binding yarns L19,L20 pass under the top transition MD yarns 1,5. The other pair of binding yarns L23,L24 is interwoven in a similar manner, but is preferably offset with respect to the pair of binding yarns L19,L20 by one or more top MD yarns. In this way, the binding yarns L19,L20;L23, L24 and the top CMD yarns A18,A22,A26 form as a whole a plain weave (web) with the top MD yarns 1-12.

It is understood that other types of weave or other weaving patterns could be used. Obviously, other weaving patterns are possible between the binding yarns L19,L20; L23,L24 and the top MD yarns 1-12 and the pairs of binding yarns L19,L20;L23,L24 can also follow weaving patterns that differ from one another.

With reference to FIGS. 2 and 3*a*,3*b*,3*c*, the bottom layer 102 includes: the bottom MD yarns 13-20, the bottom CMD yarns B17,B21,B25, and the binding portions 116 of the binding yarns L19,L20;L23,L24.

The bottom CMD yarns B17,B21,B25 are interwoven with the bottom MD yarns 13-20 with an "over1/under7" sequence. For example (FIG. 3*a*), the bottom CMD yarn B17 passes over the bottom MD yarn 17 and under the bottom MD yarns 13-16,18,20. The other bottom CMD yarns B21,B25 follow a similar "over1/under7" weaving pattern with respect to the bottom MD yarns 13-20, but each is offset with respect to the previous yarn in cross machine direction, so as to form a broken satin type weave (in particular an 8-harness broken satin).

Clearly, this is once again only an example of weave, as other weaving patterns can also be used.

The bottom layer 102 also includes (FIG. 2) the binding portions 116 of the binding yarns L19,L20;L23,L24. In the repeating unit 104, each binding yarn L19,L20;L23,L24 passes with its binding portion 116 under and binds only one bottom MD yarn 13-20 so as to define an "under1/over7" pattern with respect to the bottom MD yarns 13-20 ("over1/under7" pattern viewed from the side of the bottom surface of the fabric).

Figure 3A:
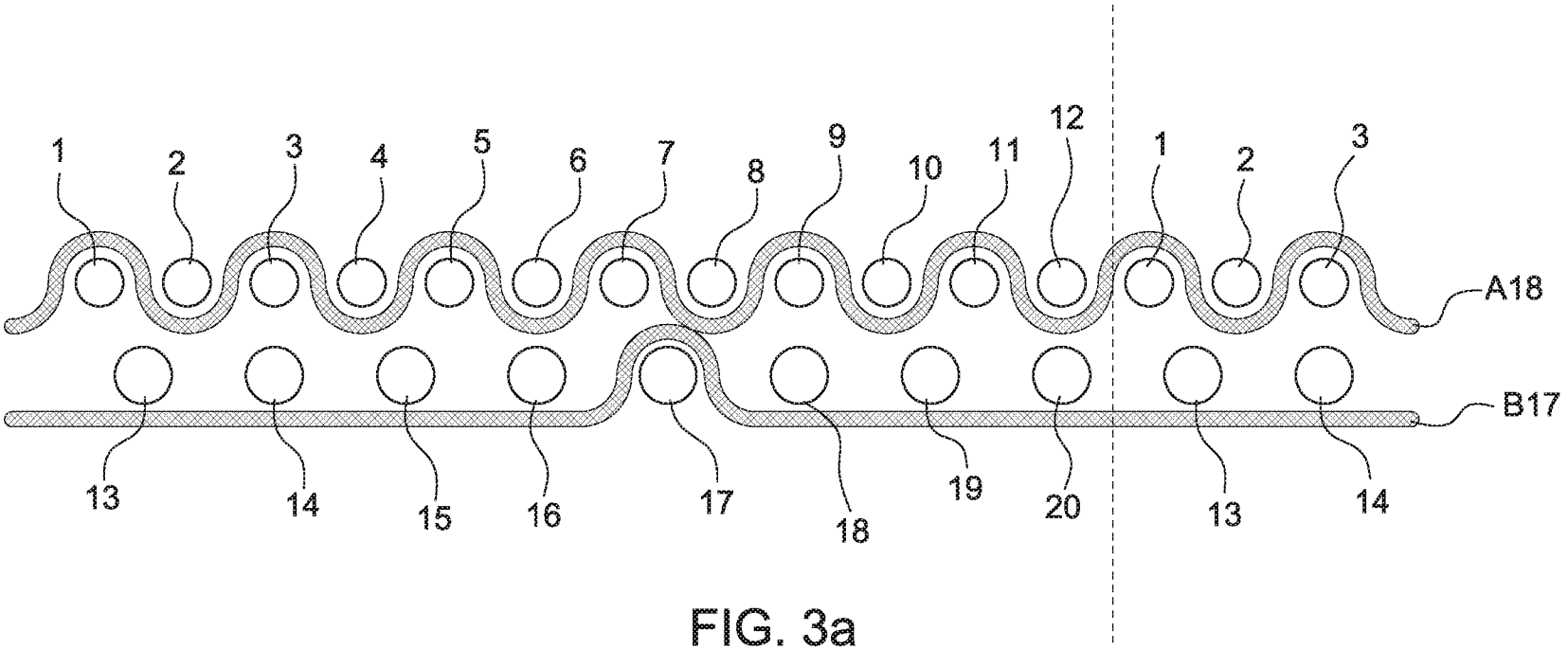
FIGS. 3*a*, 3*b*, 3*c*, are sectional views respectively according to the planes 3*a*-3*a*, 3*b*-3*b*, 3*c*-3*c* of FIG. 1.
Figure 3B:
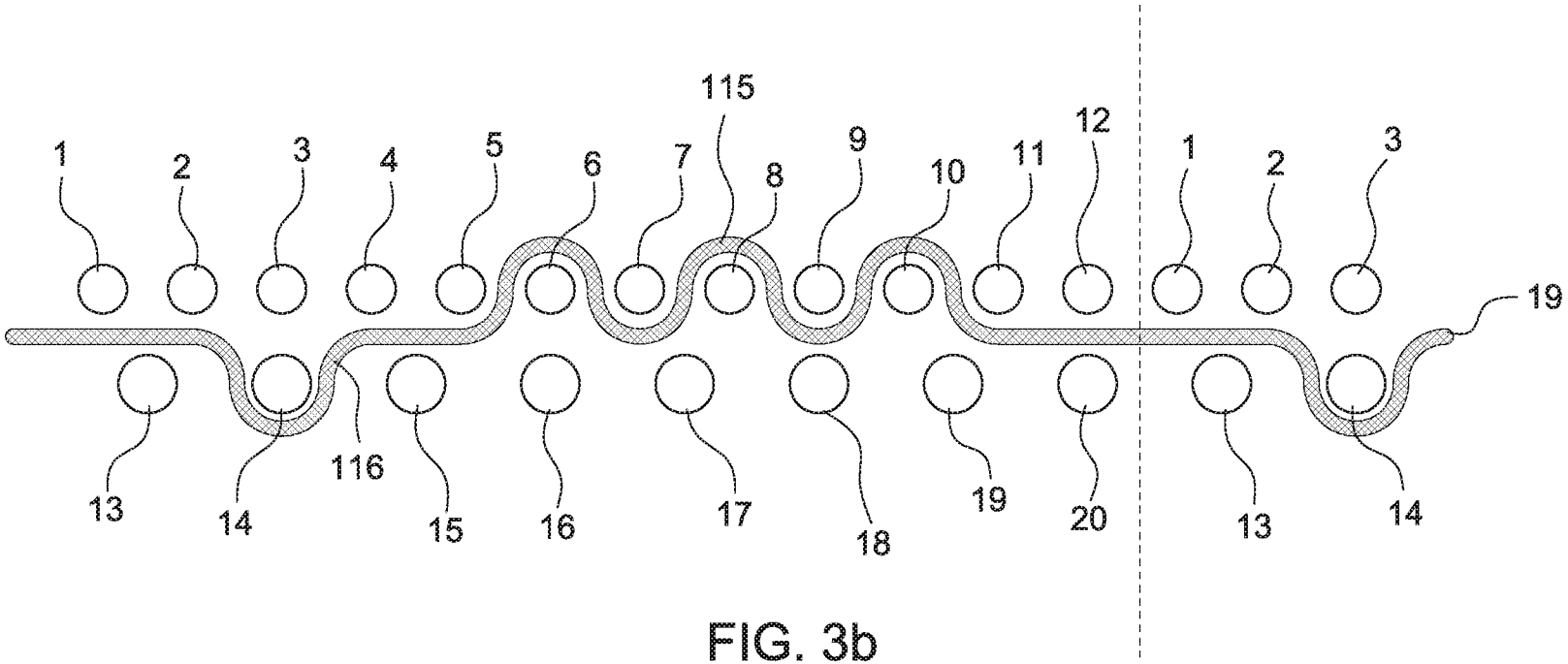
Figure 3C:
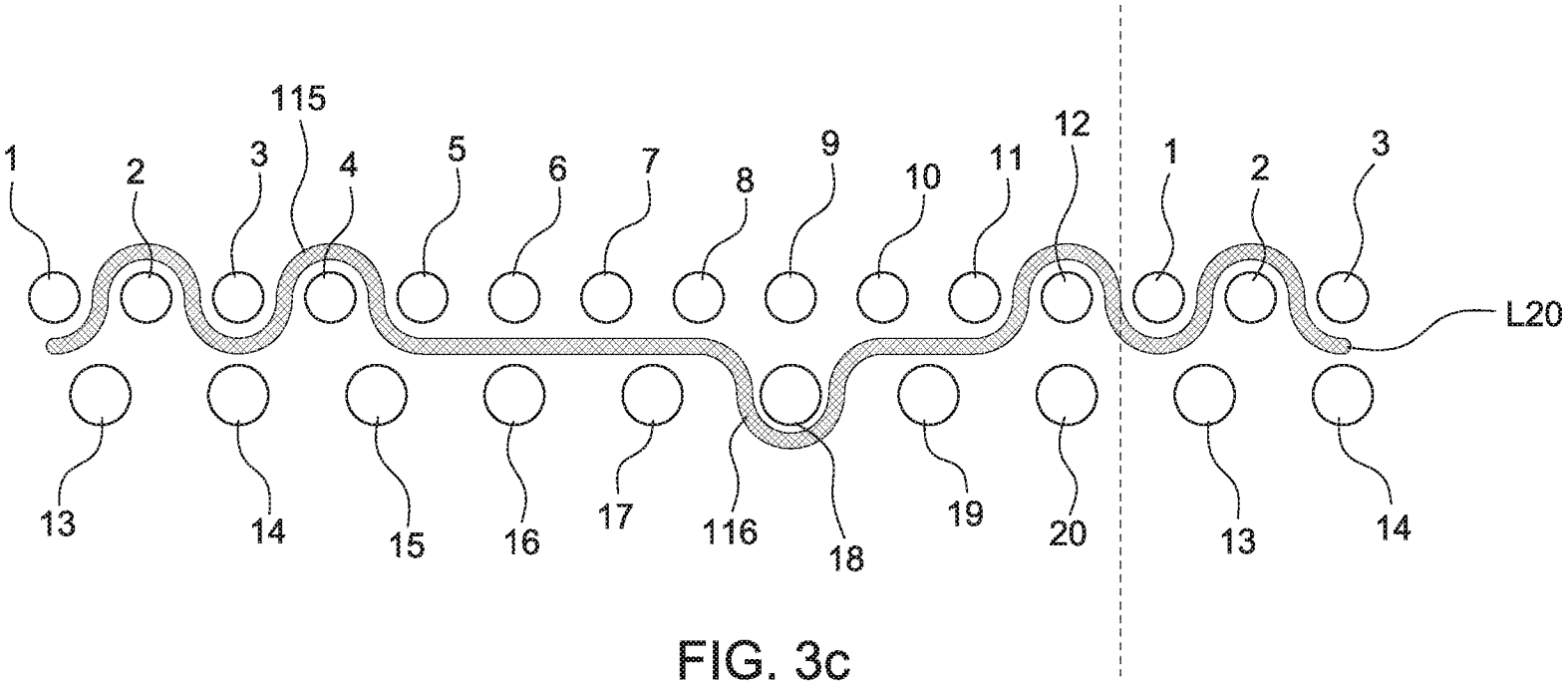

For example, the binding yarn L19 passes under the bottom MD yarn 14 and the binding yarn L20 passes under the bottom MD yarn 18; both of the binding yarns L19,L20 pass over all the other bottom MD yarns 13,15-17,18-20 (FIGS. 3*b*,3*c*).

The binding yarns L23,L24 of the other pair follow the same "under1/over7" pattern, but are preferably offset with respect to the binding yarns L19,L20 of one or more bottom MD yarns.

The binding yarns L19,L20;L23,L24 of each pair bind (i.e., pass under) respective bottom MD yarns spaced from each other by three positions (by three other bottom MD yarns).

The binding yarns L19,L20;L23,L24 of each pair arranged between two bottom CMD yarns B17,B21,B25 bind respective different (offset) bottom MD yarns 13-20, with respect to the bottom MD yarns with which the bottom CMD yarns B17,B21,B25 adjacent to the same pair of binding yarns are interwoven.

For example, the binding yarns L19,L20 arranged between the two bottom CMD yarns B17,B21 respectively bind the bottom MD yarns 14,18, while the bottom CMD yarns B17,B21 are interwoven respectively with the bottom MD yarns 17,20.

The fabric 100 has a ratio between warp yarns (MD yarns) and weft yarns (CMD yarns) of 5:4.

The ratio between warp yarns and weft yarns is meant as the ratio between the number of warp yarns that are repeated to form the fabric in cross machine direction and the number of weft yarns that are repeated to form the fabric in machine direction.

In the fabric 100 there are four weft yarns for each set of five warp yarns; this corresponds to the method of making the fabric: in weaving on a loom, four weft yarns are inserted for each set of five warp yarns.

In other words, the fabric repeating unit 104 comprises warp sets, each formed by five warp yarns (MD yarns), associated with respective weft sets, each formed by four weft yarns (CMD yarns):

each warp set is formed by three top MD yarns 1-12 and two bottom MD yarns 13-20 and is associated with a weft set formed by a top CMD yarn (one from A18,A22,A26), a bottom CMD yarn (one from B17,B21,B25) and a pair of binding yarns (L19,L20; L23,L24) between them.

In FIGS. 3*a*, 3*b*, 3*c* the warp yarns (top MD yarns 1-12 and bottom MD yarns 13-20) are schematically shown superimposed on one another to form the two layers 101, 102; in actual fact, the warp yarns take this arrangement as a result of the weave with the weft yarns (top CMD yarns A18,A22,A26, bottom CMD yarns B17,B21,B25 and binding yarns L19,L20; L23,L24), but in cross machine direction there is only one warp yarn that repeats.

Those skilled in the art will understand that the fabrics according to the present invention can take different forms. For example, in relation to the description above, the number and/or the position of the pairs of binding yarns can be varied with respect to number and/or position of the top CMD yarns (for example, there can be a pair of binding yarns every two, three or more top CMD yarns, or there can be two, three or more pairs of binding yarns for each top CMD yarn).

The number of the top and bottom CMD yarns in the fabric repeating unit can also vary with respect to the description and illustration provided purely by way of example.

Moreover, all the weaving patterns described for the layers 101, 102 can differ from those illustrated and described; for example, the top surface of the fabric does not necessarily have to be a plain weave (web) as shown, but can be of satin, twill, or similar type; and the bottom surface of the fabric does not necessarily have to be of broken satin type, but can have any other form, such as a plain weave (web), a broken twill, a twill, or similar weave. Yet other variants of weaving patterns can be used in the fabric according to the present invention.

The form of the yarns used in the fabric of the invention can also vary according to the properties to be imparted to the end product. For example, the yarns can be monofilament yarns, flat monofilament yarns, multifilament yarns, twisted multifilament or monofilament yarns, yarns of any kind, or in any combination. The materials with which the yarns are produced can be those commonly used in the field. For example, yarns made of polyester, polyamide, polyamide/polyester or the like can be used. Those skilled in the art can also select the materials of the yarns according to the specific application for which the end fabric is intended.

Moreover, yarns of various shapes (e.g., with a round or flat section) and sizes can be used. For example, the top MD yarns, the top CMD yarns and the binding yarns can have a diameter (the same as or different from each other) ranging from around 0.10 to 0.19 mm; the bottom MD yarns can have a diameter ranging from around 0.14 to 0.26 mm; the bottom CMD yarns can have a diameter ranging from around 0.21 to 0.50 mm; it is understood that these sizes are purely examples and that yarns of other sizes can be used according to the specific needs.

The mesh (i.e., the mesh size) of the fabric can also vary. For example, the mesh size of the top surface can range from around 20×30 to 25×48 (warp yarns per cm×weft insertions per cm) and the total mesh sizes can vary from around 42×60 to 65×80.

A fabric with bottom layer in REP weave with a broken weft produced according to the invention has, for example, the features indicated in Table 1.

TABLE 1

| YARN | Size |
|---|---|
| Top MD | 0.13 mm |
| Bottom MD | 0.25 mm |
| Binding | 0.12 mm |
| Top CMD | 0.13 mm |
| Bottom CMD | 0.35 mm |
| Mesh (top surface) | 24 × 54 * |
| Mesh (total) | 50 × 96 * |

* warp yarns per cm × weft insertions per cm

According to a further aspect of the invention, the fabric 100 described above is used in a papermaking process, in particular in the forming section of a papermaking machine. The method provides for the steps of:

(a) providing a papermaking fabric as described above;

(b) applying on a top surface of the fabric an aqueous cellulose pulp and/or a paper material to be formed; and (c) removing water from the pulp and/or from the paper material to be formed.

As for the rest of this process, it is essentially well known by those skilled in the art and therefore no further details are necessary.

Moreover, it is understood that further modifications and variants can be made to what has been described and illustration herein, without departing from the scope of the invention as defined in the appended claims.

The invention claimed is:

1. A triple papermaking fabric, having at least one fabric repeating unit formed by warp yarns extending in machine direction and weft yarns extending in cross machine direction, the fabric repeating unit comprising:

a set of top MD yarns;

a set of top CMD yarns interwoven with the top MD yarns to form a top fabric layer;

a set of bottom MD yarns;

a set of bottom CMD yarns interwoven with the bottom MD yarns to form a bottom fabric layer;

a set of binding yarns extending in cross machine direction and arranged in pairs between respective consecutive top CMD yarns; the binding yarns being interwoven with the top MD yarns and binding the top layer with the bottom layer;

wherein:

the fabric repeating unit consists of twelve top MD yarns, three top CMD yarns, eight bottom MD yarns, three bottom CMD yarns, and four binding yarns;

the top CMD yarns are interwoven only with the top MD yarns and do not interweave with the bottom MD yarns; and the bottom CMD yarns are interwoven only with the bottom MD yarns and do not interweave with the top MD yarns;

the binding yarns of each pair are interwoven with respective different top MD yarns, and the binding yarns, together, of the pair are interwoven with all the top MD yarns;

the binding yarns of each pair bind respective different bottom MD yarns, and each binding yarn of the pair binds only one bottom MD yarn;

in each pair of binding yarns a first binding yarn is alternately interwoven with five top MD yarns, passing alternately over three even top MD yarns and under two odd top MD yarns; and a second binding yarn is alternately interwoven with other five different top MD yarns passing alternately over respective even top MD yarns and under respective odd top MD yarns.

2. The fabric according to claim 1, wherein the ratio between warp yarns and weft yarns is 5:4.

3. The fabric according to claim 1, wherein the top MD yarns and the top CMD yarns are interwoven in such a way that each top CMD yarn passes alternately over and under all the top MD yarns.

4. The fabric according to claim 1, wherein all the top CMD yarns are interwoven with the top MD yarns in the same way, i.e. passing over and under the same top MD yarns.

5. The fabric according to claim 1, wherein each binding yarn is interwoven, passing alternately over and under, with five top MD yarns, and passes under the remaining top MD yarns to bind one bottom MD yarn.

6. The fabric according to claim 1, wherein the binding yarns of each pair pass over the top MD yarns under which the top CMD yarns pass instead.

7. The fabric according to claim 1, wherein the bottom CMD yarns are interwoven with the bottom MD yarns with a "over1/under7" sequence.

8. The fabric according to claim 1, wherein all the bottom CMD yarns follow the same "over1/under7" weaving pattern with respect to the bottom MD yarns, but each bottom CMD yarn is offset with respect to the preceding bottom CMD yarn in the cross machine direction.

9. The fabric according to claim 1, wherein each binding yarn passes under and binds only one bottom MD yarn so as to define a "under1/over7" pattern with respect to the bottom MD yarns.

10. The fabric according to claim 1, wherein the binding yarns of different pairs follow the same "under1/over7" pattern but are offset by one or more bottom MD yarns.

11. The fabric according to claim 1, wherein the binding yarns of each pair bind respective bottom MD yarns spaced by three positions from each other.

12. The fabric according to claim 1, wherein the binding yarns of each pair arranged between two bottom CMD yarns bind respective different bottom MD yarns offset with respect to the bottom MD yarns with which the bottom CMD yarns adjacent to the same pair of binding yarns are interwoven.

13. The fabric according to claim 1, wherein the fabric has a top surface having a mesh size ranging between about 20×30 and 25×48 (warp yarns per cm×weft insertions per cm).

14. Use of a fabric according to claim 1 in a papermaking machine for conveying a cellulose pulp and/or a paper material to be formed.

15. The use according to claim 14, wherein the fabric is used as a forming fabric in the forming section of the papermaking machine.

16. Papermaking method, comprising the steps of:

(a) providing a papermaking fabric according claim 1;

(b) applying on the fabric an aqueous cellulose pulp and/or a paper material to be formed; and (c) removing water from the pulp and/or paper material to be formed.

* * * * *